US011510504B2

(12) United States Patent
Lee et al.

(10) Patent No.: US 11,510,504 B2
(45) Date of Patent: Nov. 29, 2022

(54) TABLEWARE TAKING DEVICE

(71) Applicant: Kolor Magnetic (Shenzhen) Co., Ltd., Guangdong (CN)

(72) Inventors: Ching Mou Lee, Guangdong (CN); Chi Wai Lee, Guangdong (CN)

(73) Assignee: Kolor Magnetic (Shenzhen) Co., Ltd., Shenzhen (CN)

( * ) Notice: Subject to any disclaimer, the term of this patent is extended or adjusted under 35 U.S.C. 154(b) by 149 days.

(21) Appl. No.: 16/684,550

(22) Filed: Nov. 14, 2019

(65) Prior Publication Data

US 2021/0127853 A1 May 6, 2021

(30) Foreign Application Priority Data

Nov. 1, 2019 (CN) ..... 201911058251.4

(51) Int. Cl.
*A47F 1/10* (2006.01)
*A47G 21/00* (2006.01)

(52) U.S. Cl.
CPC ..... *A47F 1/10* (2013.01); *A47F 2001/103* (2013.01); *A47G 21/00* (2013.01)

(58) Field of Classification Search
CPC ..... A47F 1/10; A47F 2001/103; A47G 21/00; B65D 83/0418; B65D 83/0409
See application file for complete search history.

(56) References Cited

U.S. PATENT DOCUMENTS 2,701,722 A * 2/1955 Bone ..... B41B 1/22 276/45
2,911,127 A * 11/1959 Driss ..... G07F 11/72 221/258
3,371,821 A * 3/1968 Abood, Jr. ..... A47F 1/10 221/93
4,209,108 A * 6/1980 Winans ..... G07F 11/045 221/129
6,250,498 B1 * 6/2001 Lovejoy ..... A47F 1/04 221/185
2005/0046382 A1 * 3/2005 Chuang ..... H02J 7/0042 320/107
2005/0052510 A1 * 3/2005 Ju ..... B41J 2/1752 347/86
2007/0029340 A1 * 2/2007 Nagelski ..... A47F 1/10 221/268

(Continued)

*Primary Examiner* — Gene O Crawford
*Assistant Examiner* — Kelvin L Randall, Jr.

(57) ABSTRACT

A tableware taking device is provided, which comprising a base and a tableware taking apparatus arranged on the base. The tableware taking apparatus is further provided with a button and a connecting rod with a first end connecting the button; the base is provided with a positioning hole in which a second end of the connecting rod is inserted for fixing the tableware taking apparatus on the base. When the button is pressed downward, the second end of the connecting rod moves away from the positioning hole for detaching the tableware taking apparatus from the base; thus the tableware taking apparatus can be placed in a better way for preventing itself from turning over. In additional, the connecting rod can be controlled by the button on the tableware taking apparatus to move away from the positioning hole in the base for detaching the tableware taking apparatus from the base.

12 Claims, 6 Drawing Sheets

(56) References Cited

U.S. PATENT DOCUMENTS

| | | | | |
|---|---|---|---|---|
| 2007/0108141 | A1* | 5/2007 | Smith | A47F 1/106 211/49.1 |
| 2008/0128445 | A1* | 6/2008 | Huang | G07F 9/02 221/7 |
| 2012/0305586 | A1* | 12/2012 | Taylor | B65D 83/0817 221/36 |
| 2017/0224130 | A1* | 8/2017 | Snyder | A47F 1/10 |
| 2018/0000261 | A1* | 1/2018 | Smith | B65D 83/0876 |
| 2020/0124390 | A1* | 4/2020 | Albuquerque | F42B 39/002 |

* cited by examiner

TABLEWARE TAKING DEVICE

CROSS REFERENCE TO RELATED APPLICATIONS

The present application claims the benefit of Chinese Patent Application No. 201911058251.4 filed on Nov. 1, 2019, the contents of which are incorporated herein by reference in their entirety.

TECHNICAL FIELD

The present disclosure relates generally to tableware fields, and more particularly, to a tableware taking device.

BACKGROUND

At present, disposable tableware is more and more widely used in fast food restaurants, snack bars and other public places. Many fast food restaurants and snack bars have adopted tableware taking devices for the storage and cleaning of disposable tableware. However, these tableware taking devices are not so convenient to place and are prone to turn over.

SUMMARY

The object of the present application is to provide a tableware taking device, aiming at the above problems and defects of the prior art.

In one aspect, a tableware taking device is provided, which comprising a base and a tableware taking apparatus arranged on the base, wherein the tableware taking apparatus comprises a housing body in which a magazine for accommodating tableware is arranged, and a support assembly for supporting the tableware arranged under the magazine, wherein, a pushing member provided with a reset member for resetting itself is arranged at a side of the support assembly, wherein an inclined chute is arranged in the housing body for failing the tableware therefrom; wherein the tableware taking apparatus is further provided with a button and a connecting rod with a first end connecting the button; the base is provided with a positioning hole in which a second end of the connecting rod is inserted for fixing the tableware taking apparatus on the base; wherein when the button is pressed downward, the second end of the connecting rod moves away from the positioning hole for detaching the tableware taking apparatus from the base.

Preferably, the connecting rod comprises a starting rod, a transmission rod and a brake rod, wherein a first end of the starting rod is connected with the button, while a second end of the starting rod is connected with a first end of the transmission rod whose second end is connected with a first end of the brake rod, while the second end of the brake rod is inserted in the positioning hole; wherein when the button is pressed downward, such press is transmitted by the starting rod to the first end of the transmission rod, thus enabling the second end of the transmission rod to bring the brake rod upward for moving away from the positioning hole.

Preferably, the tableware taking device further comprises an elastic structure arranged on the tableware taking apparatus and the base for pushing the tableware taking apparatus out of the base when the tableware taking apparatus is detached.

Preferably, the elastic structure comprises a spring mounted on the tableware taking apparatus, and a top bar with a first end connected with the spring and a second end rest against the base.

Preferably, the base is arranged with a first guide groove and the tableware taking apparatus is arranged with a guide rail matched with the first guide groove.

Preferably, the reset member is arranged with a trigger for pulling the reset member thus drawing the pushing member to push the tableware into the inclined chute.

Preferably, the support assembly comprises a first bearing block and a second bearing block for supporting a tail end of the handle of the tableware, a third bearing block and a fourth bearing block for supporting the food taking part of the tableware; wherein the first bearing block and the second bearing block are respectively arranged in parallel at both sides under the handle of the tableware in the bottommost layer, while the third bearing block and the fourth bearing block are respectively arranged in parallel at both sides under the food taking part of the tableware in the bottommost layer.

Preferably, a first end of the pushing member is arranged with a pushing portion for pushing the tableware in the bottommost layer to move away from the support assembly, while a second end of the pushing member is connected with the reset member.

Preferably, a second guide grooves are respectively arranged at both sides of the magazine, and the tableware is sequentially stacked along the second guide grooves.

Preferably, a lifting plate is arranged at a bottom of the inclined chute, wherein a first end of the lifting plate is hinged at the bottom of the inclined chute, while a second end of the lifting plate is clamped with the housing body.

Preferably, the magazine is made of transparent materials and a reflective display strip is arranged inside the magazine.

Preferably, a bottom of the reflective display strip is painted to be a color which is different from that of the magazine.

Preferably, the bottom of the reflective display strip is painted to be red and a head of the reflective display strip is painted to be white.

Preferably, the tableware taking device further comprises a tableware packaging bag for loading the tableware, wherein the tableware packaging bag has a sealing mouth arranged at its outer side.

By the implementation of tableware taking device according to the present application, the tableware taking apparatus is fixed on the base by inserting its connecting rod into the positioning hole in the base, thus the tableware taking apparatus can be placed in a better way for preventing itself from turning over. In additional, the connecting rod can be controlled by the button on the tableware taking apparatus to move away from the positioning hole in the base for detaching the tableware taking apparatus from the base. In such a way, the detachment of the tableware taking apparatus is simple and convenient.

BRIEF DESCRIPTION OF THE DRAWINGS

The present application is further illustrated combining the embodiments and drawings attached.

DETAILED DESCRIPTION OF THE PREFERRED EMBODIMENT

The structure and operation principle of the tableware taking device according to the present application are further illustrated with reference to the accompanying drawings and embodiments.

Figure 1:
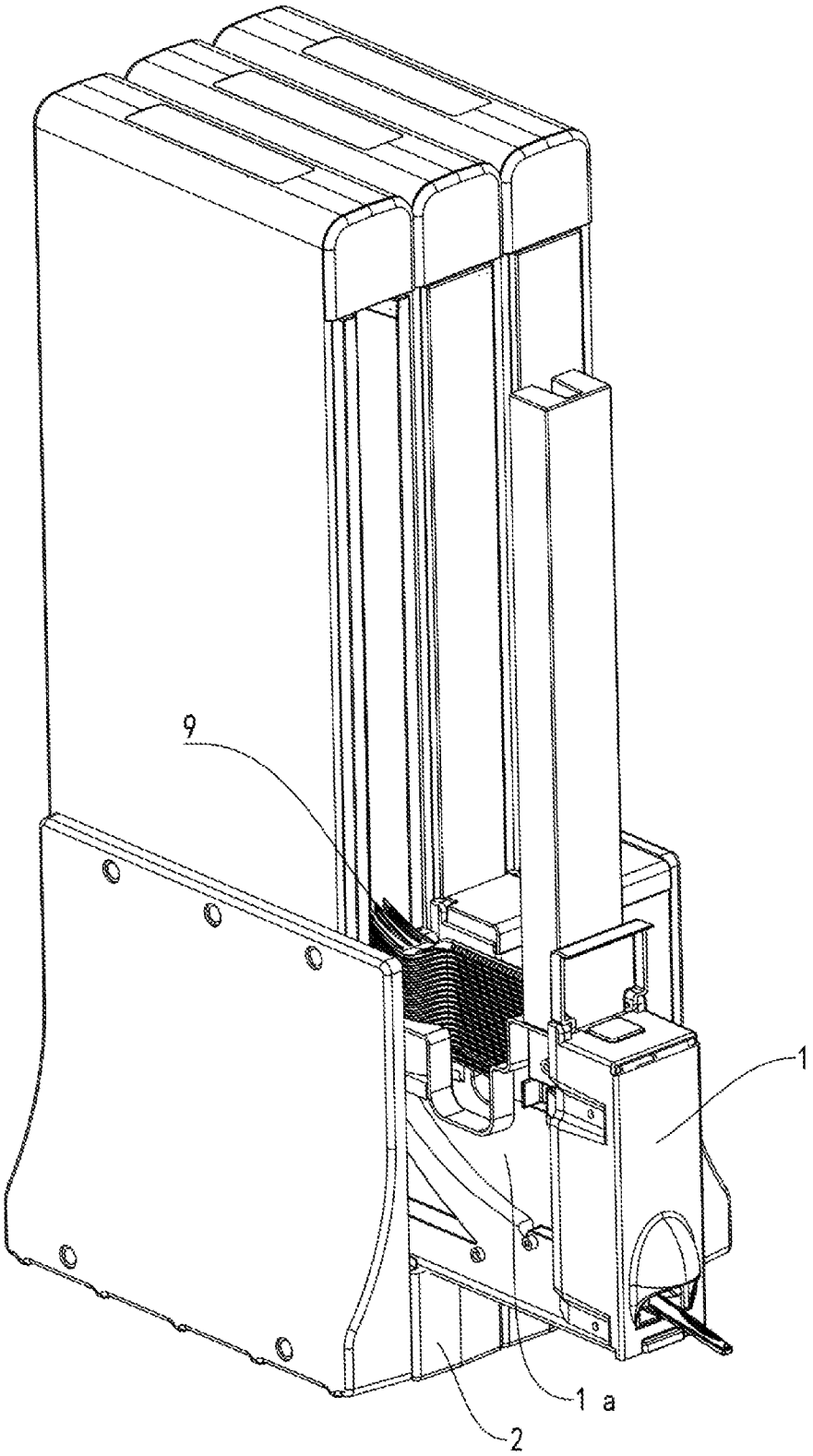
FIG. 1 is an external diagram of the tableware taking device according to a first embodiment of the present application.

In the description of the present application, it is to be understood that the terms "on", "in", "top", "bottom", and the like, indicate the orientation or positional relationship shown in the drawings. It should be noted that such orientation or positional relationship is just for convenience of description of the present application and simplification of the description, rather than indicate or imply that the pointed device or member must have such certain orientation, must be constructed and operated in a specific orientation. Therefore, such terms should not be understood as a limitation of the present application. It should be noted that all the directions mentioned in the present application, make reference to the direction shown in FIG. 1.

As shown in FIGS. 1-6, a tableware taking device, comprising a base 2 and a tableware taking apparatus 1 arranged on the base 2, is provided. The tableware taking apparatus 1 comprises a housing body 1*a* in which a magazine 4 for accommodating tableware 9 is arranged, and a support assembly 41 for supporting the tableware 9 arranged under the magazine 4. A pushing member 42 provided with a reset member 43 for resetting itself is arranged at a side of the support assembly 41. An inclined chute 5 is arranged in the housing body 1*a* for failing the tableware therefrom. The tableware taking apparatus 1 is further provided with a button 11 and a connecting rod 12 with a first end connecting the button 11. The base 2 is provided with a positioning hole 21 in which a second end of the connecting rod 12 is inserted for fixing the tableware taking apparatus 1 on the base 2. When the button 11 is pressed downward, the second end of the connecting rod 12 moves away from the positioning hole 21 for detaching the tableware taking apparatus 1 from the base 2. In the present embodiment, two positioning holes 21 are arranged, and in which one positioning hole 21 is arranged at the back end of the base 2. The tableware taking apparatus 1 is fixed on the base 2 by inserting its connecting rod 12 into the positioning hole 21 in the base 2, thus the tableware taking apparatus 1 can be placed in a better way for preventing itself from turning over. In additional, the connecting rod 12 can be controlled by the button 11 on the tableware taking apparatus 1 to move away from the positioning hole 21 in the base 2 for detaching the tableware taking apparatus 1 from the base 2. In such a way, the detachment of the tableware taking apparatus 1 is simple and convenient. The other one positioning hole 21 is arranged at the front end of the base 2, such that when the tableware taking apparatus 1 is pulled out, the connecting rod 12 can be inserted into the base 2. In such a way, the tableware can be loaded without pulling the whole tableware taking apparatus 1 out, and then the whole tableware taking apparatus 1 can be detached by pressing the button 11 when it should be neatened. Such operations are simple and convenient.

Figure 2:
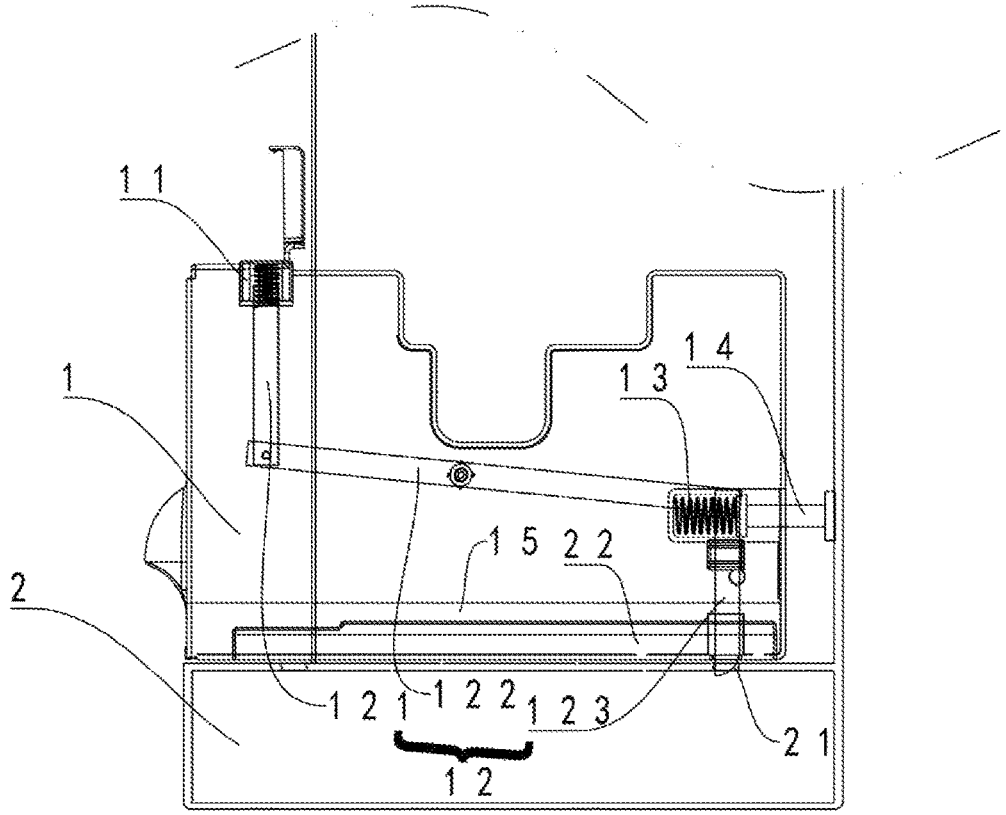
FIG. 2 is a structure diagram showing the mounting structure between the tableware taking apparatus and the base in the tableware taking device according to a second embodiment of the present application.

As shown in FIG. 2, the connecting rod 12 comprises a starting rod 121, a transmission rod 122 and a brake rod 123, wherein a first end of the starting rod 121 is connected with the button 11, while a second end of the starting rod 121 is connected with a first end of the transmission rod 122 whose second end is connected with a first end of the brake rod 123, while the second end of the brake rod 123 is inserted in the positioning hole 21. When the button 11 is pressed downward, such press is transmitted by the starting rod 121 to the first end of the transmission rod 122, thus enabling the second end of the transmission rod 122 to bring the brake rod 123 upward for moving away from the positioning hole 21.

In the preferable embodiment of the present application, the tableware taking device further comprises an elastic structure arranged on the tableware taking apparatus 1 and the base 2 for pushing the tableware taking apparatus 1 out of the base 2 when the tableware taking apparatus 1 is detached. In such a way, when the tableware taking apparatus 1 is detached, an assisted pulling force can be obtained for detaching the tableware taking apparatus 1 in a faster and more convenient way.

More preferably, the elastic structure comprises a spring 13 mounted on the tableware taking apparatus 1, and a top bar 14 with a first end connected with the spring 13 and a second end rest against the base 2. When the tableware taking apparatus 1 is detached, the spring 13 ejects the top bar 14 out. As the other end of the top bar 14 rests against the base 2, it pushes out the tableware taking apparatus 1 in an opposite direction. In addition, a spring 13 or an elastic silica gel can be arranged between the tableware taking apparatus 1 and the base 2.

In the preferable embodiment of the present application, the base 2 is arranged with a first guide groove 22 and the tableware taking apparatus 1 is arranged with a guide rail 15 matched with the first guide groove 22. In this way, the connecting rod 12 can be quickly inserted into the positioning hole 21 to install the tableware taking apparatus 1 fixedly in a very quick way. Besides, a guide wheel matched with the guide groove 22 can be arranged on the tableware taking apparatus 1 to facilitate the tableware taking apparatus 1 to slide into the base 2.

Figure 3:
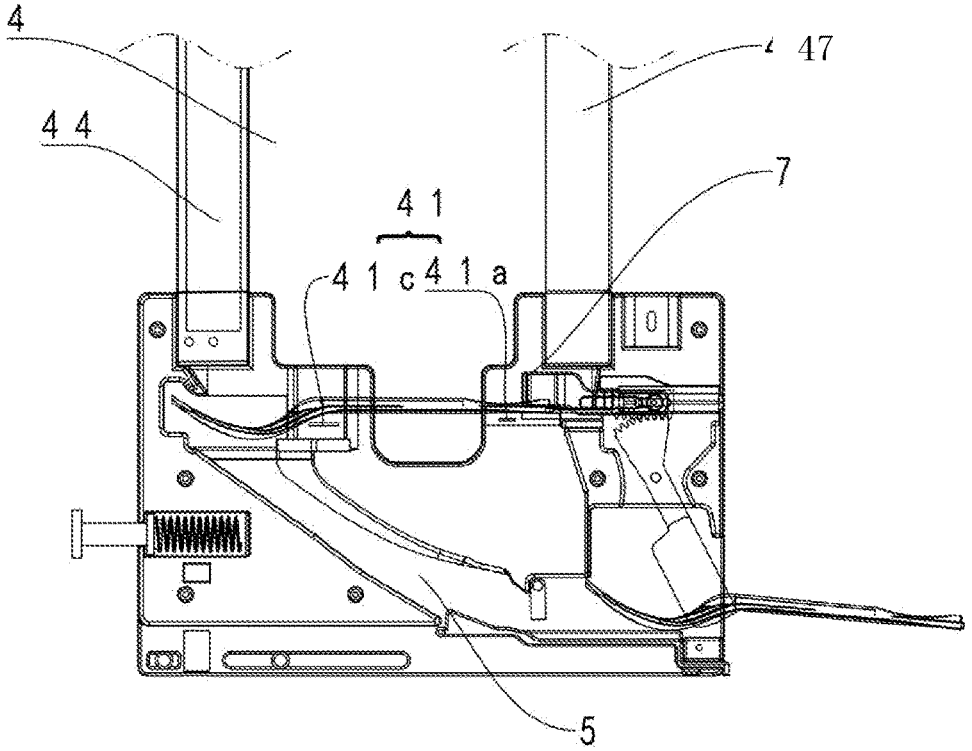
FIG. 3 is a structure diagram showing the manual tableware supplying and taking structure of the tableware taking device according to a third embodiment of the present application.

As shown in FIG. 3, the reset member 43 is arranged with a trigger 7 for pulling the reset member 43 thus drawing the pushing member 42 to push the tableware 9 into the inclined chute 5.

Figure 4:
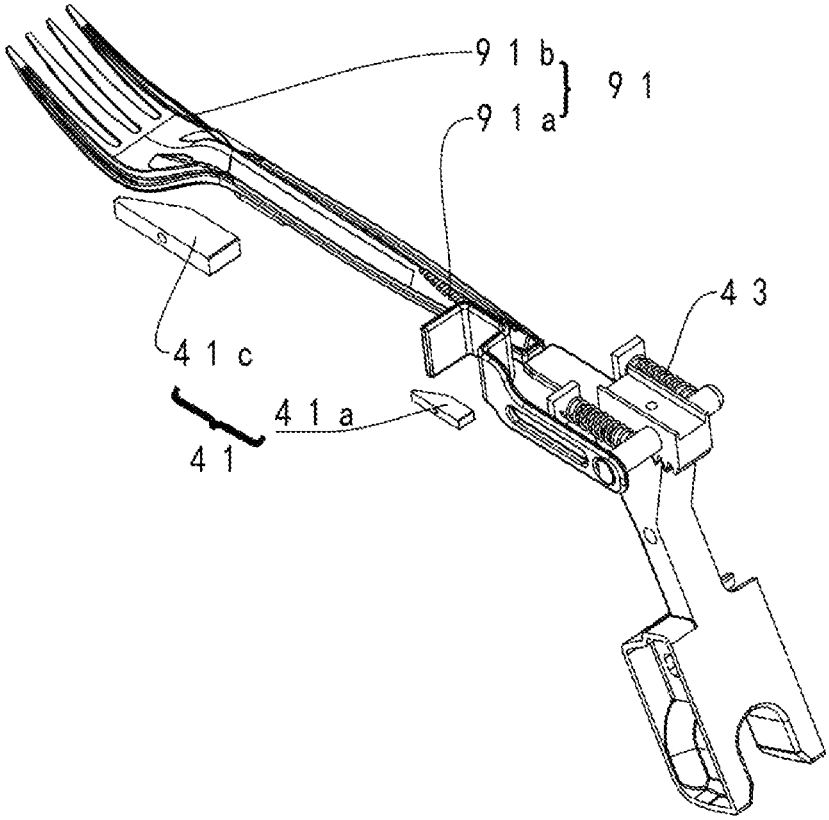
FIG. 4 is a partial structure diagram of the manual tableware supplying and taking structure in a first viewing angle.
Figure 5:
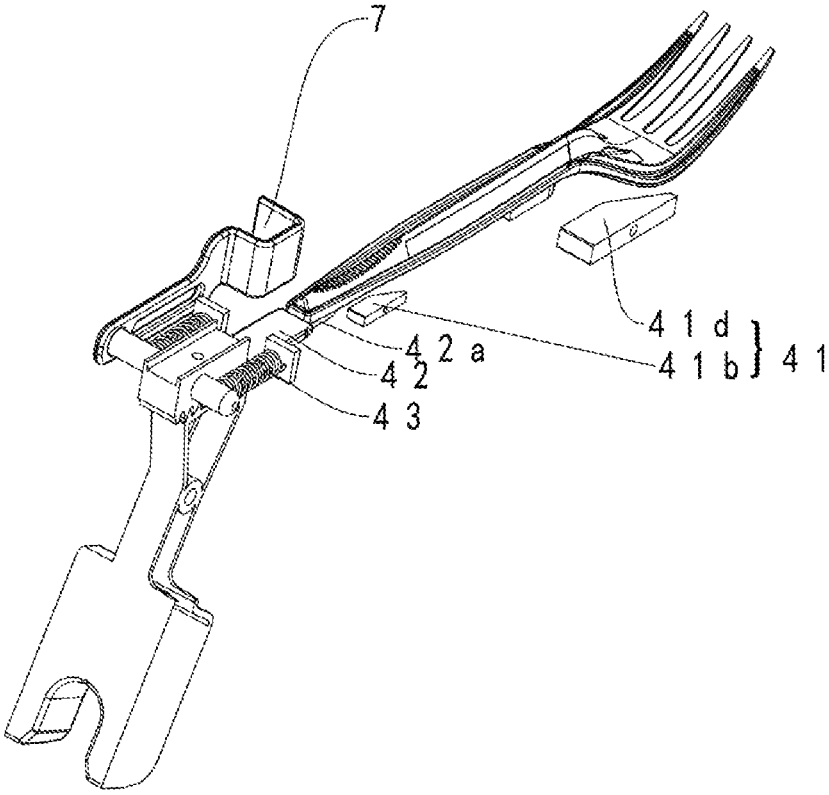
FIG. 5 is a partial structure diagram of the manual tableware supplying and taking structure in a second viewing angle.

As shown in FIGS. 4-5, the support assembly 41 comprises a first bearing block 41*a* and a second bearing block 41*b* for supporting a tail end 9*a* of the handle of the tableware 9, a third bearing block 41*c* and a fourth bearing block 41*d* for supporting the food taking part 9*b* of the tableware 9. The first bearing block 41*a* and the second bearing block 41*b* are respectively arranged in parallel at both sides under the handle 91*a* of the tableware in the bottommost layer 91, while the third bearing block 41*c* and the fourth bearing block 41*d* are respectively arranged in parallel at both sides under the food taking part 91*b* of the tableware in the bottommost layer 91. In such a way, the tableware can be held in a proper way before it has been pushed by the pushing member 42, thus preventing the tableware from falling into the inclined chute 5.

As shown in FIG. 5, a first end of the pushing member 42 is arranged with a pushing portion 42*a* for pushing the tableware in the bottommost layer to move away from the support assembly 41, while a second end of the pushing member 42 is connected with the reset member 43. The pushing portion 42*a* pushes the tableware in the bottommost layer to move away from the support assembly 41, and then falls into the inclined chute 5.

Figure 6:
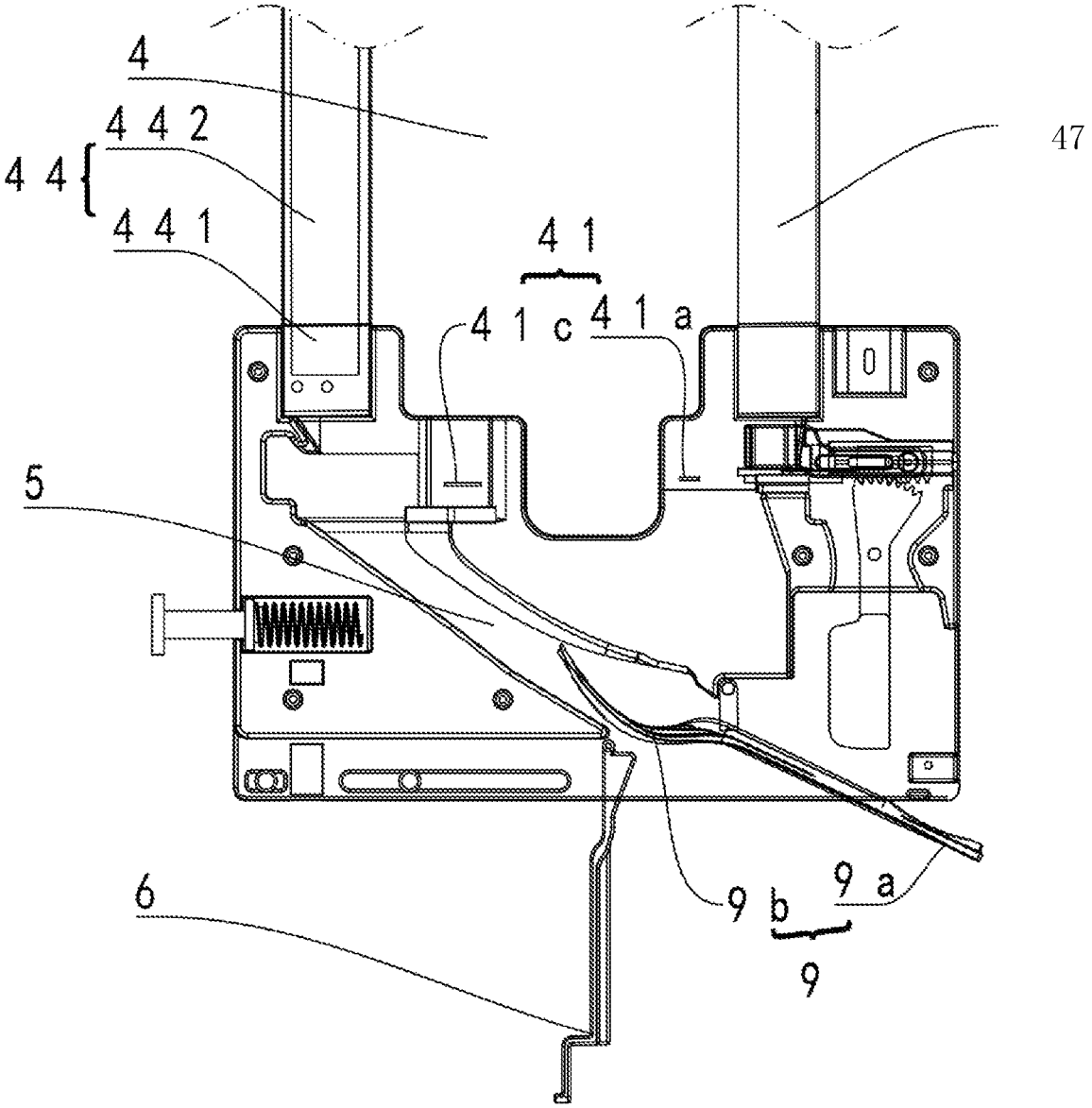
FIG. 6 is a structure diagram showing the fault structure of the tableware taking device according to a fourth embodiment of the present application.

As shown in FIG. 3 and FIG. 6, second guide grooves 47 are respectively arranged at both sides of the magazine 4, and the tableware is sequentially stacked along the second guide grooves 47.

As shown in FIG. 3 and FIG. 6, the magazine 4 is made of transparent materials, and a reflective display strip 44 is also arranged inside the magazine 4. The bottom 441 of the reflective display strip 44 according to the present application is painted to be red. Besides the red color, other colors which are obviously different from the magazine 4, such as yellow, blue, etc., also can be employed. When the tableware is used up, the red reflective display strip 44 can be exposed. This can notify the user that there is little tableware left and the user can add the tableware in time to avoid unnecessary trouble for the guests. The head 442 of the reflective display strip 44 is painted to be white, such that the light penetrates into the magazine 4 and reflects by the reflective display strip 44 would make the interior of the magazine 4 brighter, which make it easier to see the usage state of the tableware inside the magazine 4.

As shown in FIG. 6, a lifting plate 6 is arranged at a bottom of the inclined chute 5, wherein a first end of the lifting plate 6 is hinged at the bottom of the inclined chute 5, while a second end of the lifting plate 6 is clamped with the housing body 1*a*. By arranging the lifting plate 6 at the bottom of the inclined chute 5 in the housing body 1*a* of the tableware taking apparatus 1, when the tableware is blocked at the inclined chute 5, the lifting plate 6 can be opened to pick out the blocked tableware. In such a way, not all the tableware which is not fall should be taken out when the tableware is blocked. Not only the operation is simple, but also the secondary pollution of the other tableware is avoided.

Figure 7:
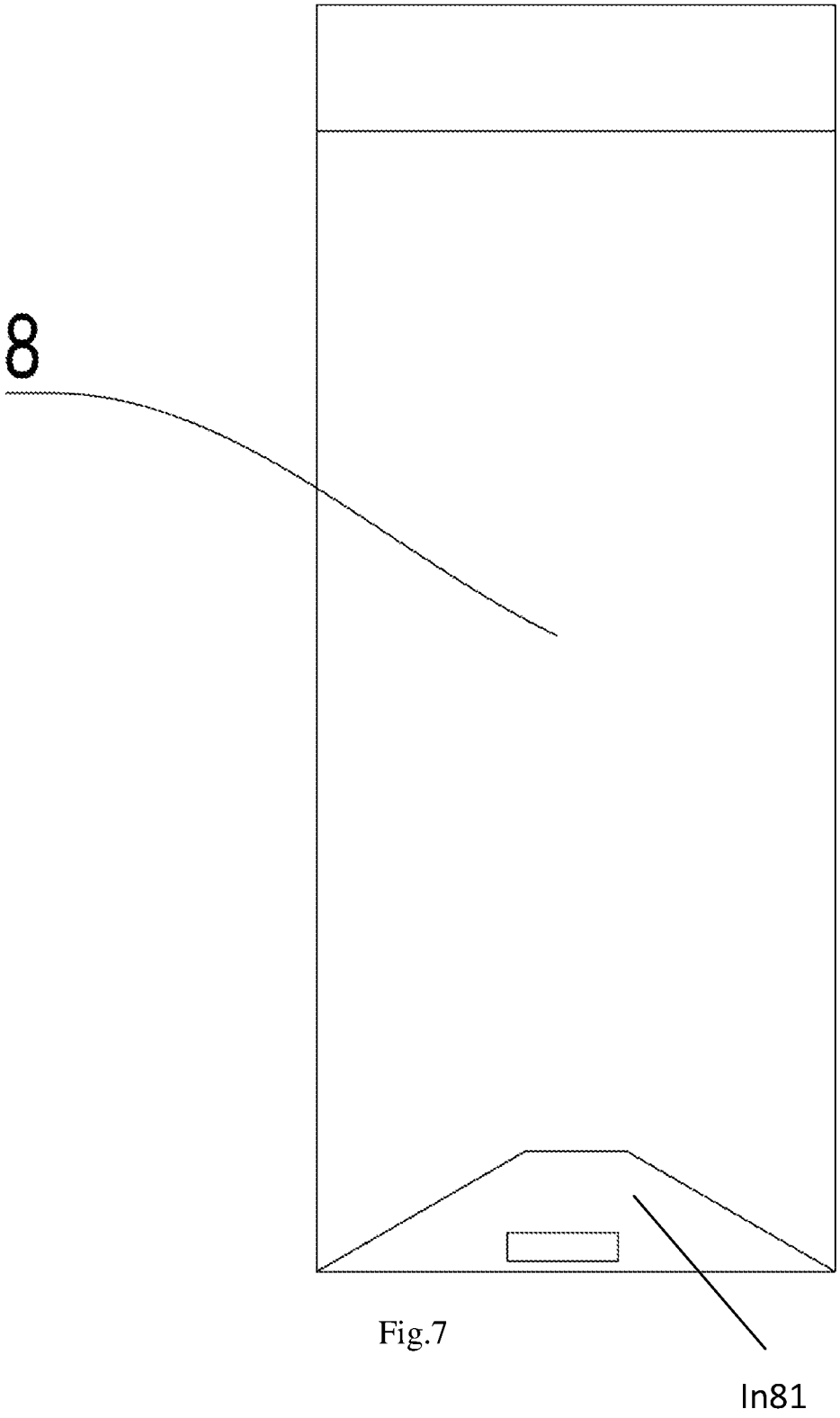
FIG. 7 is a structure diagram showing the closing state of the tableware packaging bag of the tableware taking device according to a fifth embodiment of the present application.
Figure 8:
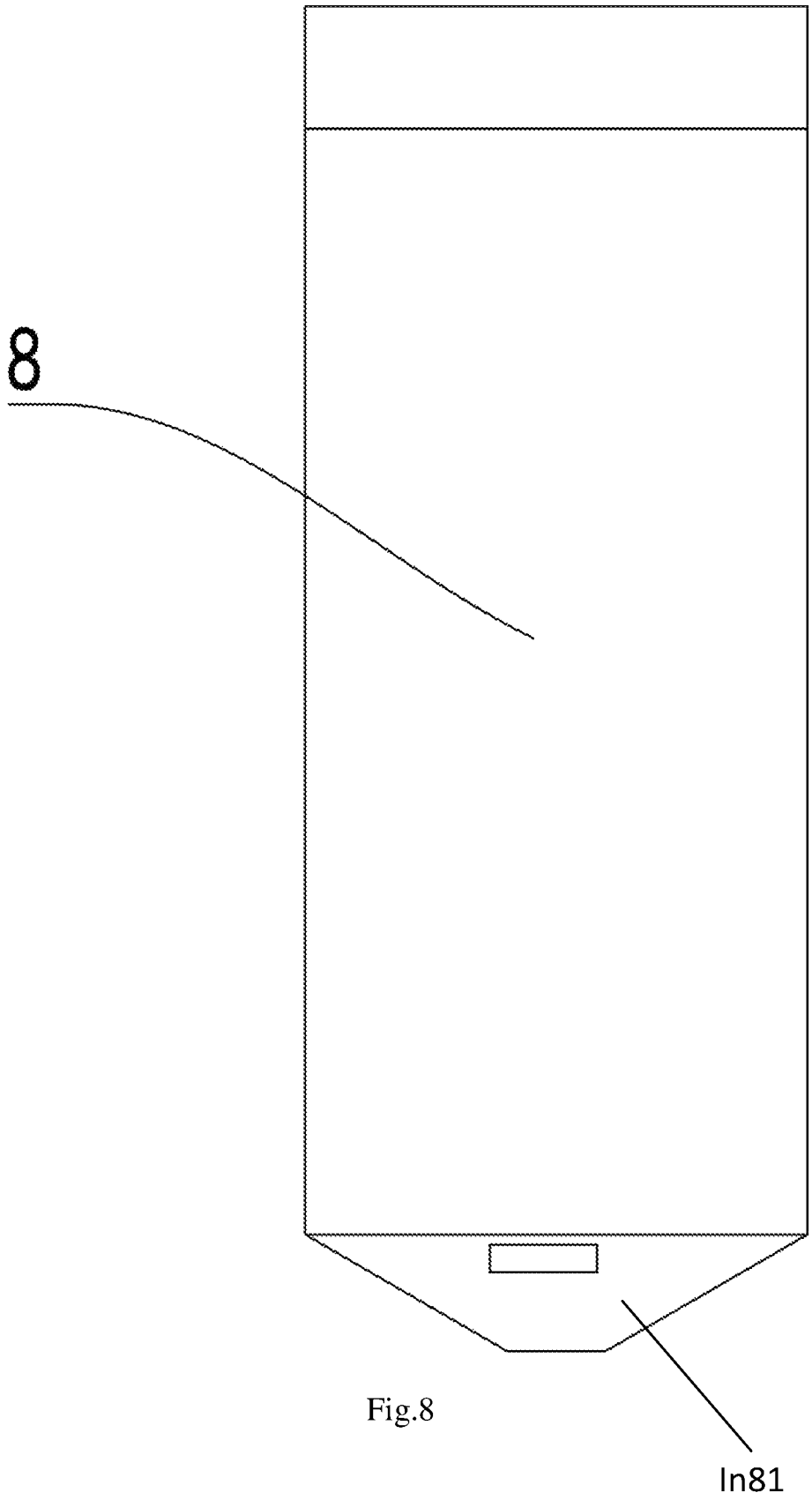
FIG. 8 is a structure diagram showing the opening state of the tableware packaging bag of the tableware taking device according to a fifth embodiment of the present application.

As shown in FIGS. 7-8, the present application is further provided with a tableware packaging bag 8 specially for loading the tableware. The common known tableware packaging bag has the sealing mouth at its bottom. Accordingly, when loading the tableware, the sealing mouth of the tableware packaging bag should be torn off for loading the tableware into the magazine 4. However, in such loading process, the tableware is easy to fall out and the tableware would be polluted. However, in the tableware packaging bag 8 according to the preferable embodiment of the present application as shown in FIGS. 7-8, the sealing mouth 81 is arranged at the outer side of the tableware packaging bag 8. When loading the tableware, the tableware together with the tableware packaging bag 8 are loaded into the magazine 4, then the sealing mouth 81 arranged at the outer side of the tableware packaging bag 8 is taken out, such that the tableware is prevented from falling out during the loading.

The foregoing is a further detailed description of the present application in connection with specific preferred embodiments, and cannot be considered as that the specific implementation of the present application is limited to these illustrations. It will be apparent to those skilled in the art that any various modifications or substitutions may be made to the present application without departing from the spirit of the invention, and such modifications or substitutions should be considered as falling within the scope of the present application.

What is claimed is:

1. A tableware taking device comprising a base and a tableware taking apparatus arranged on the base, wherein the tableware taking apparatus comprises a housing body in which a magazine for accommodating tableware is arranged, and a support assembly for supporting the tableware arranged under the magazine, wherein, a pushing member provided with a reset member for resetting itself is arranged at a side of the support assembly, wherein an inclined chute is arranged in the housing body for falling the tableware therefrom; wherein the tableware taking apparatus is provided with a button and a connecting rod with a first end connecting the button; the base is provided with a positioning hole in which a second end of the connecting rod is inserted for fixing the tableware taking apparatus on the base; wherein when the button is pressed downward, the second end of the connecting rod moves away from the positioning hole for detaching the tableware taking apparatus from the base;

wherein the connecting rod consists of a starting rod, a transmission rod and a brake rod which are all straight, wherein the starting rod and the brake rod are approximately perpendicular to the transmission rod which is arranged in a horizontal direction; wherein a first end of the starting rod is extended upward in a vertical direction to be connected with the button, while a second end of the starting rod is connected with a first end of the transmission rod whose second end is connected with a first end of the brake rod, while the second end of the brake rod is extended downward in a vertical direction to be inserted in the positioning hole which is a though hole arranged inside the base along a longitudinal direction; wherein when the button is pressed downward, such press is transmitted by the starting rod to the first end of the transmission rod, thus enabling the second end of the transmission rod to bring the brake rod upward along the longitudinal direction for moving away from the positioning hole; when the button is released, the brake rod vertically falls off by its gravity to be inserted in the positioning hole;

wherein the support assembly comprises a first bearing block and a second bearing block for supporting a tail end of a handle of the tableware, a third bearing block and a fourth bearing block for supporting a food taking part of the tableware; wherein the first bearing block and the second bearing block are respectively arranged in parallel and oppositely under the handle of the tableware in a bottommost layer, while the third bearing block and the fourth bearing block are respectively arranged in parallel and oppositely under the food taking part of the tableware in the bottommost layer.

2. The tableware taking device according to claim 1, wherein the tableware taking device further comprises an elastic structure arranged on the tableware taking apparatus and the base for pushing the tableware taking apparatus out of the base when the tableware taking apparatus is detached.

3. The tableware taking device according to claim 2, wherein the elastic structure comprises a spring mounted on the tableware taking apparatus, and a top bar with a first end connected with the spring and a second end rest against the base.

4. The tableware taking device according to claim 1, wherein the base is arranged with a first guide groove and the tableware taking apparatus is arranged with a guide rail matched with the first guide groove.

5. The tableware taking device according to claim 1, wherein the reset member is arranged with a trigger for pulling the reset member thus drawing the pushing member to push the tableware into the inclined chute.

6. The tableware taking device according to claim 1, wherein a first end of the pushing member is arranged with a pushing portion for pushing the tableware in the bottom-most layer to move away from the support assembly, while a second end of the pushing member is connected with the reset member.

7. The tableware taking device according to claim 6, wherein a second guide grooves are respectively arranged at both sides of the magazine, and the tableware is sequentially stacked along the second guide grooves.

8. The tableware taking device according to claim 1, wherein a lifting plate is arranged at a bottom of the inclined chute, wherein a first end of the lifting plate is hinged at the bottom of the inclined chute, while a second end of the lifting plate is clamped with the housing body.

9. The tableware taking device according to claim 1, wherein the magazine is made of transparent materials and a reflective display strip is arranged inside the magazine.

10. The tableware taking device according to claim 9, wherein a bottom of the reflective display strip is painted to be a color which is different from that of the magazine.

11. The tableware taking device according to claim 10, wherein the bottom of the reflective display strip is painted to be red and a head of the reflective display strip is painted to be white.

12. The tableware taking device according to claim 1, wherein the tableware taking device further comprises a tableware packaging bag for loading the tableware, wherein the tableware packaging bag has a sealing mouth arranged at its outer side.

* * * * *